United States Patent [19]

Smit

[11] Patent Number: 4,492,834

[45] Date of Patent: Jan. 8, 1985

[54] FLOAT CONTROL FOR A SWITCH

[75] Inventor: Gerard C. Smit, Amerongen, Netherlands

[73] Assignee: Smitdesign B.V., Amerongen, Netherlands

[21] Appl. No.: 367,956

[22] Filed: Apr. 13, 1982

[30] Foreign Application Priority Data

Apr. 24, 1981 [NL] Netherlands ..... 8102042

[51] Int. Cl.[3] ..... H01H 35/18

[52] U.S. Cl. ..... 200/84 R; 73/322.5

[58] Field of Search ..... 200/84, 84 R, 84 A, 200/84 B, 84 C; 73/308, 322.5

[56] References Cited

U.S. PATENT DOCUMENTS

| | | | |
|---|---|---|---|
| 2,136,220 | 11/1938 | Shepherd | 200/84 B |
| 2,611,048 | 9/1952 | Reading | 220/84 R |
| 2,826,919 | 3/1958 | Klingler | 403/51 |
| 2,957,060 | 10/1960 | Culley | 200/84 R |
| 3,028,463 | 4/1962 | Birch | 200/81.9 R |
| 3,050,605 | 8/1962 | Pollak | 200/302 |
| 3,686,451 | 8/1972 | Potthurst, Jr. | 200/84 R |
| 4,180,095 | 12/1979 | Woolley et al. | 200/84 R X |
| 4,289,154 | 9/1981 | Quayle | 200/84 R X |

FOREIGN PATENT DOCUMENTS

| | | |
|---|---|---|
| 1076782 | 8/1960 | Fed. Rep. of Germany . |
| 1206663 | 8/1959 | France . |
| 420107 | 11/1934 | United Kingdom . |

*Primary Examiner*—J. R. Scott

*Attorney, Agent, or Firm*—Scully, Scott, Murphy & Presser

[57] ABSTRACT

A float control for a pushbutton switch, including a float having a fixed pivot inside a float chamber, and a two-armed lever with a fixed fulcrum. One arm of the lever contacts the push-button switch for actuation thereof, said the other lever arm is connected to the float in a position spaced from the float. This other lever arm pivots in a manner allowing for relative pivoting and sliding movement, so that the lever does not impede any movement of the float, and any such float movement is fully translated into imparting control forces to the lever.

6 Claims, 2 Drawing Figures

1
2
3
4
5
6
7
8
9
10
11
12
13
14
15
16
17
18
19
20

FLOAT CONTROL FOR A SWITCH

BACKGROUND OF THE INVENTION

1. Field of the Invention

This invention relates to a float control for a switch, in particular, but not exclusively, for use in a coffee making machine with a water reservoir and an electrical throughflow heater, for switching said throughflow heater on and off, depending on the presence of water in said reservoir.

2. Discussion of the Prior Art

A coffee making machine which comprises, in the water path from the reservoir through the throughflow heater to a coffee filter, directly under the water reservoir, a float chamber with a float which when the reservoir is empty occupies such a position that, as a result, a switch breaks the electrical circuit of the throughflow heater, thereby preventing the apparatus from boiling dry, is described in applicant's U.S. Pat. No. 3,619,561 and in the corresponding German Pat. No. 1,926,826. In it, the switch is a stationary mercury switch mounted on the float body.

Although coffee making machines equipped with such mercury switches built-in in the float have functioned excellently in large numbers and for many years, and still do, there are some drawbacks, which the present invention seeks to meet.

Thus the prior float-switch unit is relatively expensive, because high demands are made on the manufacture thereof with regard to tightness and the vacuum level in the mercury switch. Furthermore, when the switch production is put out to contract, it is difficult for the manufacturer of the coffee making machines to check the float-switch unit as to the above aspects before mounting the same.

As, in coffee making machines, among others, one failure to switch off the power supply to the water heater when the water reservoir is empty can already result in damage requiring repair in a workshop, it is an object of the present invention to provide a float control for a mechanical switch that can be arranged at a remote position from a float, and nevertheless can be controlled by the float in a reliable manner.

SUMMARY OF THE INVENTION

For this purpose, according to the invention, the float control for a push-button switch, in which the float has a fixed pivot inside a float chamber, comprises a two-armed lever with a fixed fulcrum, one arm of which lever actuates said switch, and the other arm of which lever is mounted in the float in a floating condition and in spaced relationship to the float pivot.

Proper operation of the float requires it to move freely about its pivot. Proper operation of the lever requires it to turn freely about its fulcrum without twisting or straining. In the construction according to the invention, both conditions are met. The fixed fulcrum of the lever can be selected for reliable operation of the switch, that is to say in such a manner that the force exerted on the switch has an optimum direction relative to the switch. The relative positions of float and switch are often dictated by the design of the apparatus in which they are used. By properly selecting the position of the floating bearing of the lever in the float relative to the float pivot and the lever fulcrum, however, it can always be ensured that the float movement results in a force directed substantially at right angles to the float lever. A further favourable aspect of a two-armed lever is that it can be made with dissimilar arms so that the force exerted on it by the float can be reinforced for operation of the switch.

For mounting the lever in the float in a floating fashion, the relevant end of the lever may be accommodated, according to the invention, in a sleeve provided in the float, in which this end can pivot and slide, which results in the exercise of a force on the lever, derived from both vertical and horizontal components of motion of the float, and which is also a simple and effective solution from the point of view of assembly.

For mounting the float in the float chamber with a fixed pivot, use could be made of a pivot shaft journalled in opposite walls of the float chamber.

Preferably, however, the float is provided with at least one ridge projecting from it, which ridge rests on the bottom of a notch formed in said float chamber and having a wide aperture angle, said float being held with the free edge of said ridge on the bottom of the notch by a flexible tube, which tube also serves for the passage of the lever.

In this way the tube forms a separation between a wet zone in which the float is operative, and a dry zone in which the lever and the switch are situated. The lever can be passed to the interior of the float by way of the tube, without the need of any seals which would hamper the operation of the float or of the lever. Furthermore, housing the floating lever bearing in the dry interior of the float prevents the floating bearing from becoming fouled in the course of time, thereby detracting from the reliability of the switch operation.

An optimum arrangement with regard to the exercise of force by the float on the lever is that in which the lever arm that is coupled with the float can be pivoted about the fulcrum between end positions located on opposite sides of a line extending over the bottoms of the notches in the float chamber.

In the switch operation according to the invention, each movement of the float, both upwards and downwards and lateral, is converted into a force exerted on the lever, which contributes to the operation of the switch. By virtue of this, there is a great degree of freedom with regard to the selection of the switch, in particular the threshold value thereof. Moreover, the operating mechanism is virtually insensitive to fouling from water.

It is noted that U.S. Pat. No. 3,028,463 (Birch) discloses a switch apparatus with a two-armed lever, one arm of which operates the switch, and the other of which is controlled by a float, in which the lever arm in question is connected with the float by means of a coupling which permits sliding and pivoting movements. In that case, however, the float is only capable of making vertical movements, owing to being guided on a central pin, and its operation is extremely sensitive to fouling from water.

BRIEF DESCRIPTION OF THE DRAWINGS

One embodiment of the invention will now be described, by way of example, with reference to the accompanying drawings, in which.

DETAILED DESCRIPTION

Figures 1, 2:
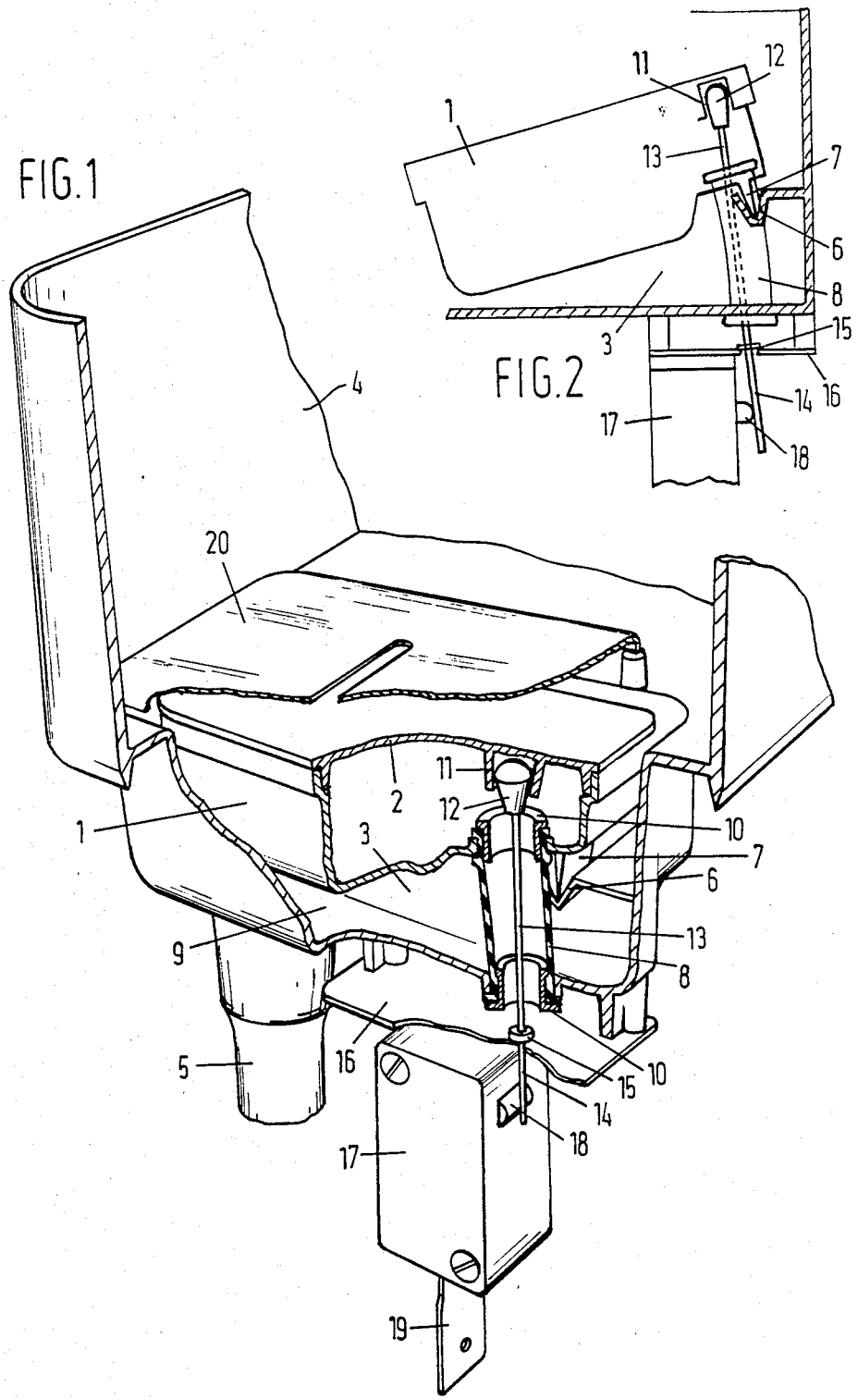
FIG. 1 is a part-sectional perspective view of the float chamber of a coffee making machine incorporating the float control according to the present invention.
FIG. 2 is a diagrammatic view showing the essential elements of the float control for a switch used in the coffee making machine of FIG. 1.

Referring to the drawings, a float 1 with a cover 2 is mounted in a float chamber 3 under a water reservoir 4. The outlet of the reservoir, via float chamber 3, is designated by 5.

Formed in float chamber 3, on opposite sides of a flexible tube 8, are notches 6, in which ridges 7, connected to the bottom of the float, are received.

Flexible tube 8 is sealingly connected with float 1 and with the bottom 9 of float chamber 3 by means of nipples 10. In this way float 1 is capable of freely pivoting up and down in float chamber 3, using the bottom of notch 6 as a fixed pivot.

Formed on the inside of float cover 2 is a sleeve 11, in which a head 12, secured to the free end of a lever arm 13 can freely pivot and in addition slide axially. The lever arm 13 forms part of a two-armed lever 13, 14, the arm 14 being preferably shorter than arm 13.

The fulcrum of lever 13, 14 is determined by a stop 15, which cooperates with an aperture in a plate 16 secured against the underside of the bottom 9 of the float chamber.

The shorter lever arm 14 operates the push button 18 of a switch 17. There are further shown a fastening means 19 for switch 17, and a hood 20 mounted above float 3 in water reservoir 4.

Referring to FIG. 2, the operation of the device is as follows.

When float 1 moves up and down within float chamber 3, depending on the water level in the float chamber, the float pivots about a fixed pivot, that is to say, for vertical pivoting movement a line determined by the bottom of notches 6.

Upon such vertical pivoting movements of float 1, lever arm 13 is pivoted via sleeve 11 and head 12 to the right and to the left, as viewed in FIG. 2, about a fixed fulcrum determined by the passage of lever arm 14 through plate 16, and stop 15 on lever 13, 14.

In this way, a relatively large pivoting movement of float 1 is converted into a relatively large force which lever 14 is capable of exerting on the push button 18 of switch 17.

I claim:

1. A float control assembly for a push-button switch, said assembly comprising a float chamber, a float having a fixed, substantially horizontally extending pivot axis being located within said float chamber; a two-armed lever having a fulcrum, one arm of said lever extending substantially at right angles to the said float pivot axis, said lever arm and said float being mutually connected within said float, said connection being spaced from said pivot axis and facilitating mutual pivoting movements, said lever being slideable at least at its fulcrum and the other lever arm actuating said push-button.

2. A float control assembly as claimed in claim 1, comprising a sleeve within said float, wherein for mutually connecting said other lever arm and said float, one end of said lever arm extends at a clearance within said sleeve, said lever arm end being slideable and pivotable within said sleeve.

3. A float control assembly for a push-button switch, comprising a float chamber having a notch with a wide aperture angle, a float having at least one ridge projecting therefrom supported on the bottom of said notch to form a fixed, substantially horizontally-extending pivot axis for said float; a two-armed lever having a fulcrum spaced from said float pivot axis, one arm of said lever tangentially abutting the switch push-button and the other arm extending substantially at right angles to the said float pivot axis; a flexible tube holding the float with the free edge of said ridge supported on the bottom of said notch, said other arm passing through said tube, the free end of said other lever arm and said float being mutually connected within said float spaced from said float pivot axis and facilitating at least mutual pivoting movements.

4. A float control assembly as claimed in claim 3, comprising a sleeve within said float, wherein for mutually connecting said other lever arm and said float, one end of said lever arm extends at a clearance within said sleeve, said lever arm end being slideable and pivotable within said sleeve.

5. A float control assembly as claimed in claim 3, wherein the lever arm coupled with the float is pivotable by said float about said fulcrum between two end positions located on opposite sides of said float pivot axis.

6. A float control assembly for a push-button switch, said assembly comprising a float chamber having a notch with a wide aperture angle, a float having at least one ridge projecting therefrom and resting on the bottom of said notch to form a fixed, substantially horizontally extending pivot axis for said float; a two-armed lever with a fulcrum spaced from said float pivot axis, one arm of said lever tangentially abutting the switch push-button and the other arm extending substantially at right angles to the said float pivot axis; a flexible tube holding the float with the free edge of said ridge on the bottom of said notch, said other arm passing through said tube, the free end of said other lever arm and said float being mutually connected within said float spaced from said float pivot axis and facilitating at least mutual pivoting movements; a sleeve within said float, wherein for mutually connecting said other lever arm and said float, the one end of said lever arm extends at a clearance within said sleeve, said lever arm end being slideable and pivotable within said sleeve, and the lever arm coupled with the float is pivotable by said float about said fulcrum between end positions located on opposite sides of said sleeve pivot axis.

* * * * *